US008800781B1

(12) United States Patent
Carlile, Jr. et al.

(10) Patent No.: US 8,800,781 B1
(45) Date of Patent: Aug. 12, 2014

(54) DISC FOR DISC SCREEN

(76) Inventors: Robert William Carlile, Jr., Santa Ana, CA (US); Rodney H. Sewell, Santa Ana, CA (US)

( * ) Notice: Subject to any disclaimer, the term of this patent is extended or adjusted under 35 U.S.C. 154(b) by 0 days.

(21) Appl. No.: 13/620,296

(22) Filed: Sep. 14, 2012

Related U.S. Application Data

(60) Provisional application No. 61/534,886, filed on Sep. 14, 2011.

(51) Int. Cl.
*B07B 13/00* (2006.01)

(52) U.S. Cl.
USPC ..... 209/671; 209/672; 492/38; 492/39; 403/204

(58) Field of Classification Search
USPC ..... 209/271, 667, 671, 672; 29/895.2, 29/895.21, 895.213; 492/38–40; 403/204
See application file for complete search history.

(56) References Cited

U.S. PATENT DOCUMENTS 2,743,813 A * 5/1956 Erickson ..... 209/668
3,306,441 A * 2/1967 Sanders et al. ..... 209/672
4,402,390 A * 9/1983 Feeney ..... 193/37
4,795,036 A * 1/1989 Williams ..... 209/667
5,590,792 A * 1/1997 Kobayashi ..... 209/667
5,868,036 A * 2/1999 Salzman ..... 74/450
6,250,478 B1 * 6/2001 Davis ..... 209/672
7,261,209 B2 * 8/2007 Duncan et al. ..... 209/672
7,578,396 B1 * 8/2009 Garzon ..... 209/667
7,661,537 B1 * 2/2010 Sewell ..... 209/671
8,517,181 B1 * 8/2013 Davis et al. ..... 209/672
8,522,983 B2 * 9/2013 Davis ..... 209/672

* cited by examiner

*Primary Examiner* — Joseph C Rodriguez
(74) *Attorney, Agent, or Firm* — Frederic M. Douglas

(57) ABSTRACT

A partially releasable disc for processing recycling materials in general. More specifically a disc that is sufficiently flexible to function in heavy machinery without excessive wear while maintaining sufficient stiffness to avoid excessive fluctuations, wobbling, or other undesired excess deflection in the disc. An outer flexible portion may be wrapped around a less flexible core. A disc may comprise a plurality of outer impacting elements configured for engaging materials to be classified and propelling the materials in a conveying direction when a core is rotated. For ease of replacement, when the flexible portion is worn or damaged, the flexible portion may be removed without necessarily removing the inner core, saving labor and equipment expense when maintain a screen, such as the separation screens used for sorting recycled materials.

15 Claims, 6 Drawing Sheets

Section B-B

Section A-A

DISC FOR DISC SCREEN

CROSS-REFERENCE TO RELATED APPLICATION

The application claims priority from U.S. Provisional Patent Application No. 61/534,886, filed on Sep. 14, 2011, the contents of which are incorporated herein by reference.

BACKGROUND OF THE INVENTION

A disc screen typically includes a frame in which a plurality of rotatable shafts are mounted in parallel relationship. A plurality of discs is mounted on each shaft and a chain drive rotates the shafts in the same direction. The discs on one shaft interleave with the discs on each adjacent shaft to form screen openings between the peripheral edges of the discs. The size of the openings determines the dimension (and thus the type) of material that will fall through the screen. Rotation of the discs, which have an irregular outer contour, agitates the mixed recyclable materials to enhance classification. The rotating discs also propel the larger articles which are too big to fall between the discs across the screen. The general flow direction extends from an input area where the stream of material pours onto the disc screen to an output where the larger articles pour off of the disc screen. The smaller articles fall between the discs onto another disc screen or a conveyor, or into a collection bin.

The discs of a disc screen normally have a central opening or bore that permits the discs to be slid over an end of a shaft which may have a round or square cross-section. See for example U.S. Pat. No. 4,836,388 of Bielagus. Eventually, discs wear out and must be replaced. It is not practical to refurbish or repair damaged or worn discs without removing them from the shafts of the disc screen. However, it is tedious to dismount the ends of the shafts of a disc screen from their respective bearings so that the old discs may be removed and replaced by sliding the discs off the ends of the shafts. If only a single disc is worn or broken, it is usually necessary to remove several discs before the damaged or broken disc may be slid off the shaft for replacement.

Previous attempts have been made to develop spot discs as manufactured by CP Manufacturing, Inc. of National City, Calif. See U.S. Pat. No. 6,318,560 of Robert M. Davis. The split disc is comprised of two identical halves which are assembled around a shaft and tightly held together by a pair of bolt assemblies which clamp the disc to the shaft. Each disc half is made of an outer rubber portion which is stiffened with a rigid internal metal frame embedded inside the rubber portion. While the aforementioned patented two-piece disc construction has been commercially successful, it would be desirable to provide a disc construction that is even more convenient to remove and install while offering a lower part cost for replacement of worn or damaged discs in a disc screen.

Past inventions have attempted to provide useful discs comprising rigid, metal frames embedded within a flexible material, such as urethane, such that the rigid, metal frame extends substantially in a radial direction within the flexible material to provide stiffness to the disc. A disadvantage with these past inventions is that excessively rigid metal frames can be expensive and heavy. A load of discs may be shipped long distances at rated depending upon the freight weight. A load of discs laden with heavy, rigid, metal frames can be excessively costly to transport. A lighter disc would offer substantial savings when multiplied by the number of discs shipped at a lighter freight weight. Additionally, using less metal (or even no metal) may reduce material costs, machining time, other factors to provide an improved disc.

Thus it would be advantageous to use a disc that minimizes manufacturing costs, comfortably operates, saves freight costs, reduces weight of the device, and provides stability in rotation, and offers a flexible outer surface, optionally with a tongue-and-groove feature, particular clamping features, and other beneficial features.

SUMMARY OF THE INVENTION

In one aspect of the present invention, a disc for attachment to a shaft in a disc screen apparatus may comprise an outer flexible material, the outer flexible material consisting of one piece, without a hinge or interconnecting flap, and a disc core connected to the outer flexible material with a mating connection.

In another aspect of the present invention, a disc for a recycling apparatus may comprise a disc core configured to engage a shaft member to locate the disc core on the shaft member, and an outer flexible portion removably mounted to the disc core to project beyond the disc core to contact waste material being processed by a recycling apparatus as the shaft member rotates, wherein the outer flexible portion comprises of one piece, without a hinge or interconnecting flap.

In a further aspect of the present invention, a disc for releasable attachment to a shaft in a disc screen apparatus for classifying mixed recyclable materials may comprise: an inner frame; an outer material partially covering the inner frame and defining an outer impacting surface with a generally square shape for engaging and propelling mixed recyclable materials in a conveying direction along a disc screen; the inner frame and the outer material covering the frame being separable into a plurality of portions, the portions being configured to provide an opening for receiving a shaft of the disc screen apparatus; and means for releasably clamping the portions around the shaft, wherein the inner frame is situated less than 50% of the radial distance between an inner diameter of the disc and the outer perimeter of the disc. The inner frame may be situated less than 25% of the radial distance between an inner diameter of the disc and the outer perimeter of the disc. Additionally, another frame may be situated, in addition to a first inner frame, over 59% of the radial distance between an inner diameter of the disc and the outer perimeter of the disc.

In a still further aspect of the present invention, a disc and shaft assembly for a disc screen of a recycling apparatus configured to separate mixed recyclable materials according to size may comprise a shaft having opposite ends configured to be rotatably supported in a frame of a recycling apparatus, a plurality of discs mounted at spaced intervals along the shaft to rotate with the shaft and configured for classifying a stream of mixed recyclable materials, each disc comprising an outer flexible portion, the outer flexible portion consisting of one piece, without a hinge or interconnecting flap and a disc core connected to the outer flexible portion with a mating connection, the shaft extending transversely through bores within the plurality of discs, and each outer flexible portion material is shaped for engaging materials to be classified and propelling the materials in a conveying direction when the disc core is rotated.

These and other aspects, objects, features and advantages of the present invention, are specifically set forth in, or will become apparent from, the following detailed description of an exemplary embodiment of the invention.

BRIEF DESCRIPTION OF THE DRAWINGS

The above and other aspects of the present invention will become more apparent by the following detailed description of exemplary embodiments thereof with reference to the attached drawings, in which.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention relates generally to discs for processing recycling materials in general. More specifically to a disc that is sufficiently flexible to function in heavy machinery without excessive wear while maintaining sufficient stiffness to avoid excessive fluctuations, wobbling, or other undesired excess deflection in the disc. The present invention relates to machines used to separate particulate materials or mixed recyclable materials into different fractions, and more particularly, to a disc construction for a disc screen that allows discs to be more easily separated, removed, and replaced.

The invention may be useful in the recycling industry. For example, the invention's disc may be used in a disc screen for classifying material by size, shape, or other features with discs mounted in rows. The present invention may be used for recycling, sorting, grading, measuring, treating, and other similar uses for various materials.

Figure 1A:
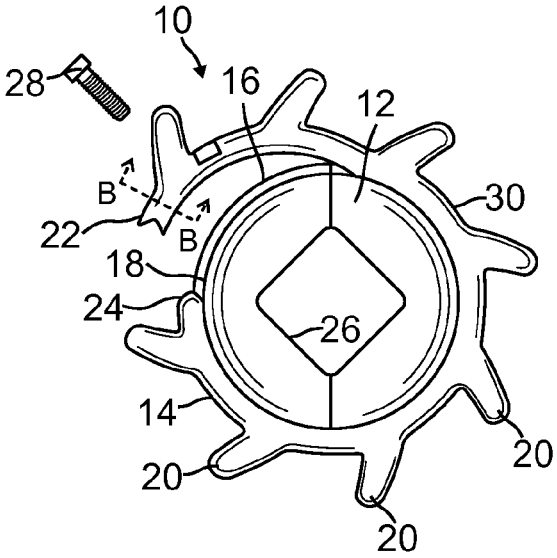
FIG. 1A illustrates a disc, according to an embodiment of the present invention.

Referring now to the drawings in detail, wherein like reference characters refer to like elements, there is shown in FIG. 1A a disc 10 according to one embodiment of the present invention. A disc core 12 comprising a durable material, such as steel, or other suitable materials, may be wrapped alongside a circumference by an outer flexible material or portion 14. The outer flexible material 14 may be comprised of a polymer, such as polyurethane, rubber, rubber-like materials, or other suitable material. The disc core 12 may comprise a protuberance, such as an outer tongue or ridge 16 extending radially outward from the center of the disc core 12. A lip 18 may be located at a circumference of the disc core 12, such as at a location between the center of the disc core 12 and an outer circumference of the ridge 16.

The outer flexible material 14 may contain protuberances, such as a plurality of fingers 20 integrally formed as an appendage to a radial perimeter 30 of the outer flexible material 14. The outer flexible material 14 may be wrapped around a perimeter of the disc core 12. The outer flexible material 14 may comprise two ends, 22, 24, which may mesh in a mating arrangement. The outer flexible material 14 is constructed without a hinge or interconnecting flap and a disc core (as described below) may be connected to the outer flexible portion 14 with a mating connection. The mating connection may comprise a tongue-and-groove connection or other suitable connection for joining the outer flexible material 14 to a disc core 12. The disc core 12 may comprise a passage 26 for engagement with a shaft in a disc screen apparatus. Although FIG. 1A depicts a passage 26 with a square shape, it is to be understood that the passage 26 may be of any suitable shape to effectively engage with a shaft. Also, the ridge 16 and lip 18 may comprise a convex, concave, or other form to engage in a mating arrangement with the outer flexible material 14, as later described regarding FIG. 6. The outer flexible material 14 may be further secured to the disc core 12 by one or more bolts 28.

Figure 1B:
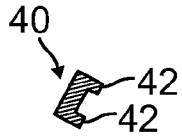
FIG. 1B illustrates the flexible portion from FIG. 1A seen along section B-B, according to an embodiment of the present invention.

In FIG. 1B a portion 40 of the outer flexible material 14 may be viewed along section BB such that ridges 42 may mate with the lip 18 and the disc core ridge 16 may fit in between ridges 42.

Figure 2:
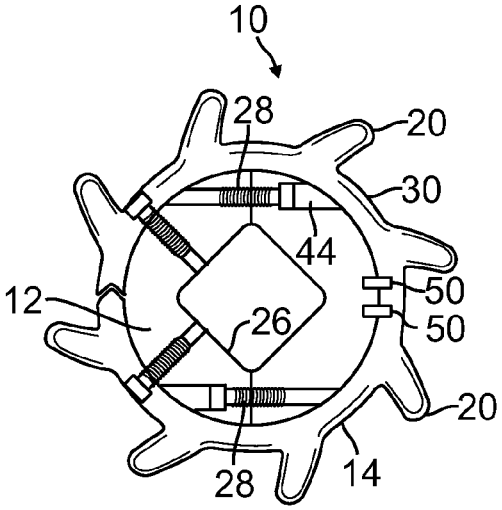
FIG. 2 illustrates the disc from FIG. 1A secured in a closed manner according to an embodiment of the present invention.

FIG. 2 shows an exemplary method of securing the outer flexible material 14 to the disc core 12. Bolts 28 are inserted into bores 44 at various distances through the disc 10 to secure portions of the disc core 12 (if the disc core 12 comprises more than one portion) and to secure the outer flexible material 14 to the disc core 12. One or more studs 50 may be used to secure the outer flexible material 14 to the disc core 12.

Figure 3:
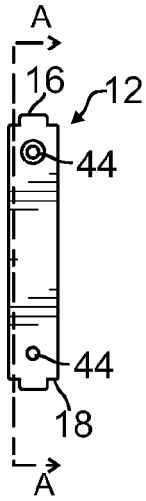
FIG. 3 is side view of a disc core according to another embodiment of the present invention.

A side view of a disc core 12 is shown in FIG. 3, showing the bores 44 arranged along the perimeter of the disc core 12.

Figure 4:
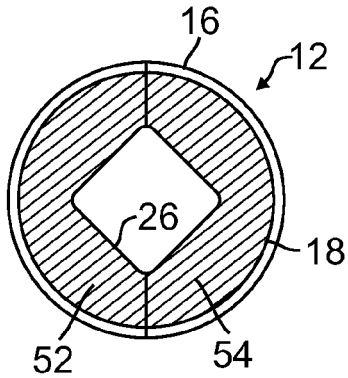
FIG. 4 is an elevation view of the disc core from FIG. 3, viewed along section A-A according to yet another embodiment of the present invention.

FIG. 4 shows the disc core 12 of FIG. 3, viewed along section A-A. As can be seen in FIG. 4, the disc core 12 may be separable into a plurality of portions 52, 54 that may be assembled around a shaft.

Figure 5:
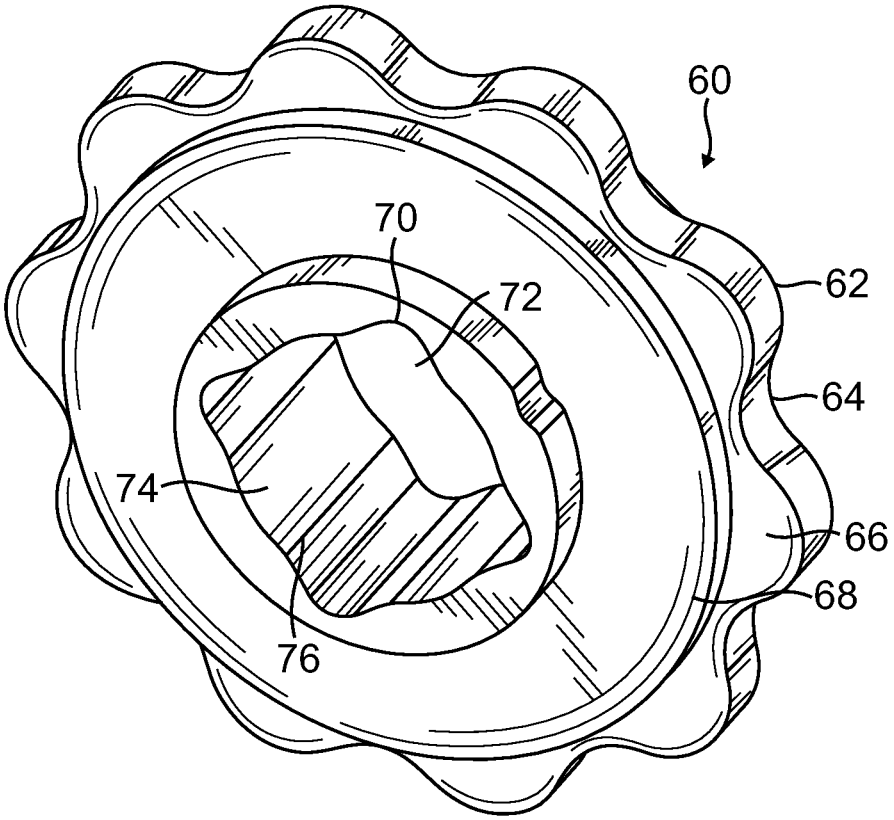
FIG. 5 is a perspective view of a disc core, according to a further embodiment of the present invention.

A disc core 60 according to another embodiment of the present invention is shown in FIG. 5. An outer ridge 62 may extend radially from the center passage 72. The outer ridge 62 may comprise concave portions 64 and convex portions 66. Lip 68 may extend radially between lip 70 and outer ridge 62 for engagement with mating portions of an outer flexible portion. The center passage 72 may comprise concave portions 74 and convex portions 76 for engagement with a shaft to rotate the disc core 60.

Figure 6:
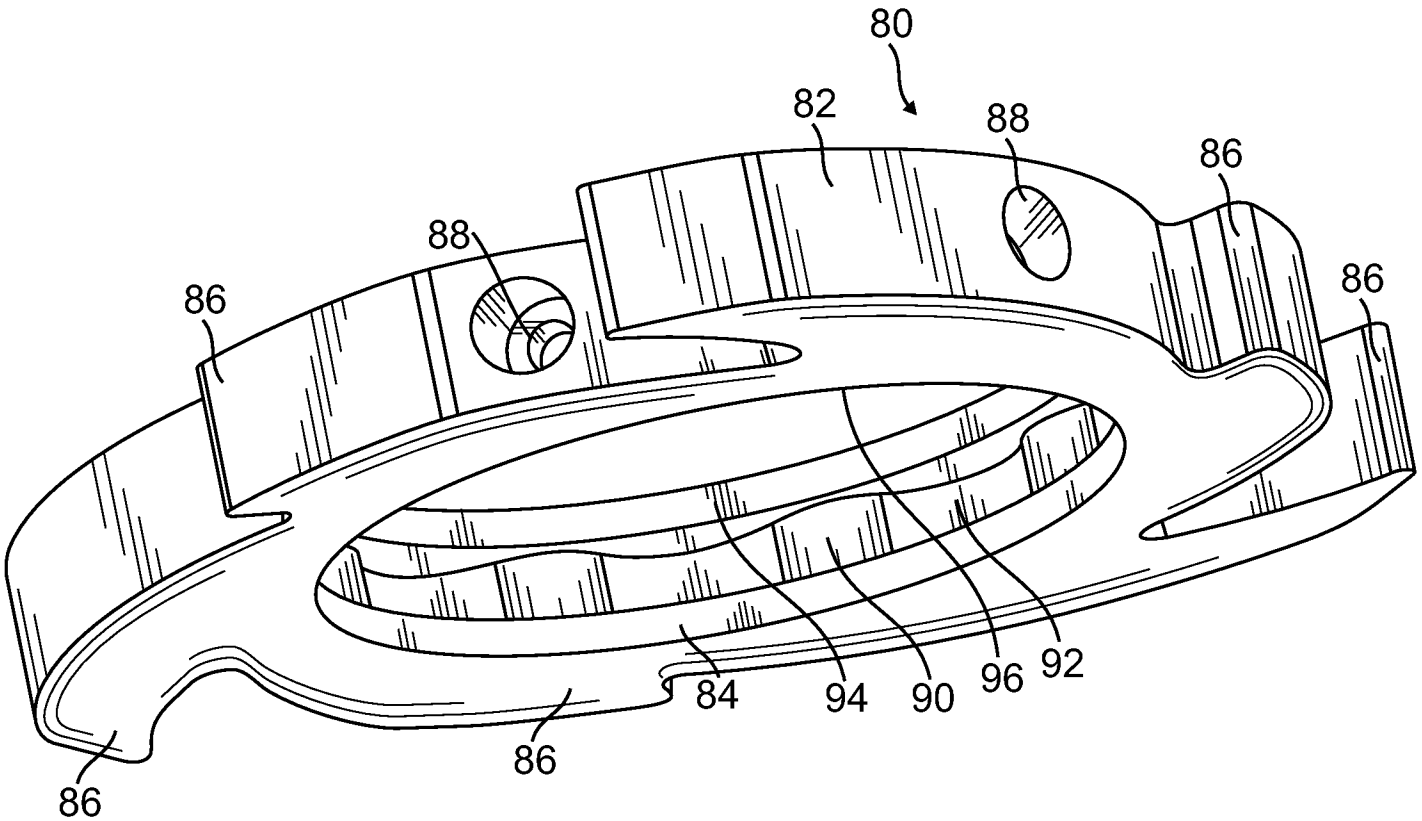
FIG. 6 is a perspective view of a flexible portion of a disc, according to a yet further embodiment of the present invention.

An outer flexible material 80, which may be suitable for a disc core 60 (as shown in FIG. 5), is shown in FIG. 6. The outer perimeter 82 of the outer flexible material 80 may comprise a plurality of fingers 86 integrally formed as appendages. Ranges 84 and 94 may be integrally formed within the inner aperture 96 of the outer flexible material 80. Convex portions 90 and concave portions 92 may be situated within the interior or the outer flexible material 80 to engage with an outer perimeter of a disc core 80 (as discussed above regarding FIG. 5). At least one bore 88 may guide bolts (such as bolts 28 shown in FIG. 2) to secure the outer flexible material 80 to a disc core (such as disc core 60 described above regarding FIG. 5).

Figure 7:
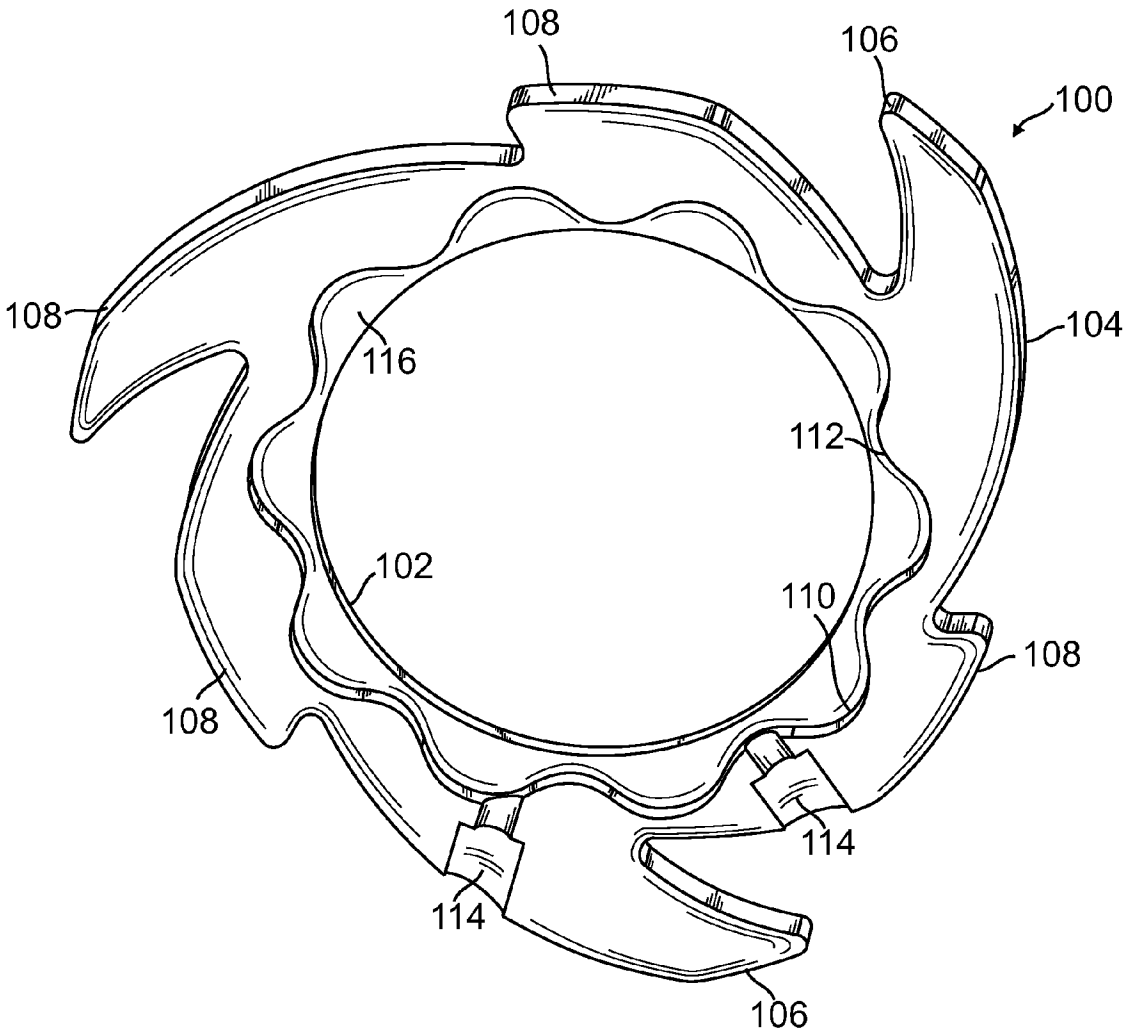
FIG. 7 is a cross-section view of a flexible portion of a disc, according to an additional embodiment of the present invention.

FIG. 7 shows a cross-sectional view of an outer flexible material 100. An inner aperture 102 and an outer perimeter, such as contoured outer surface 104, may be considered to reference various components. The contoured outer surface 104 comprises various shapes to contact waste material being processed by a recycling apparatus. Long fingers 106 and short fingers 108 may be integral protuberances for engaging mixed recyclable materials. A lip 116 may be separated from the inner aperture 102 with at least one concave portion 110 and at least one convex portion 112 to engage with an outer perimeter of a disc core 80 (as discussed above regarding FIG. 5). One or more bores 114 may be placed along the span of the outer flexible portion 100 for attachment to a disc core.

Figure 8:
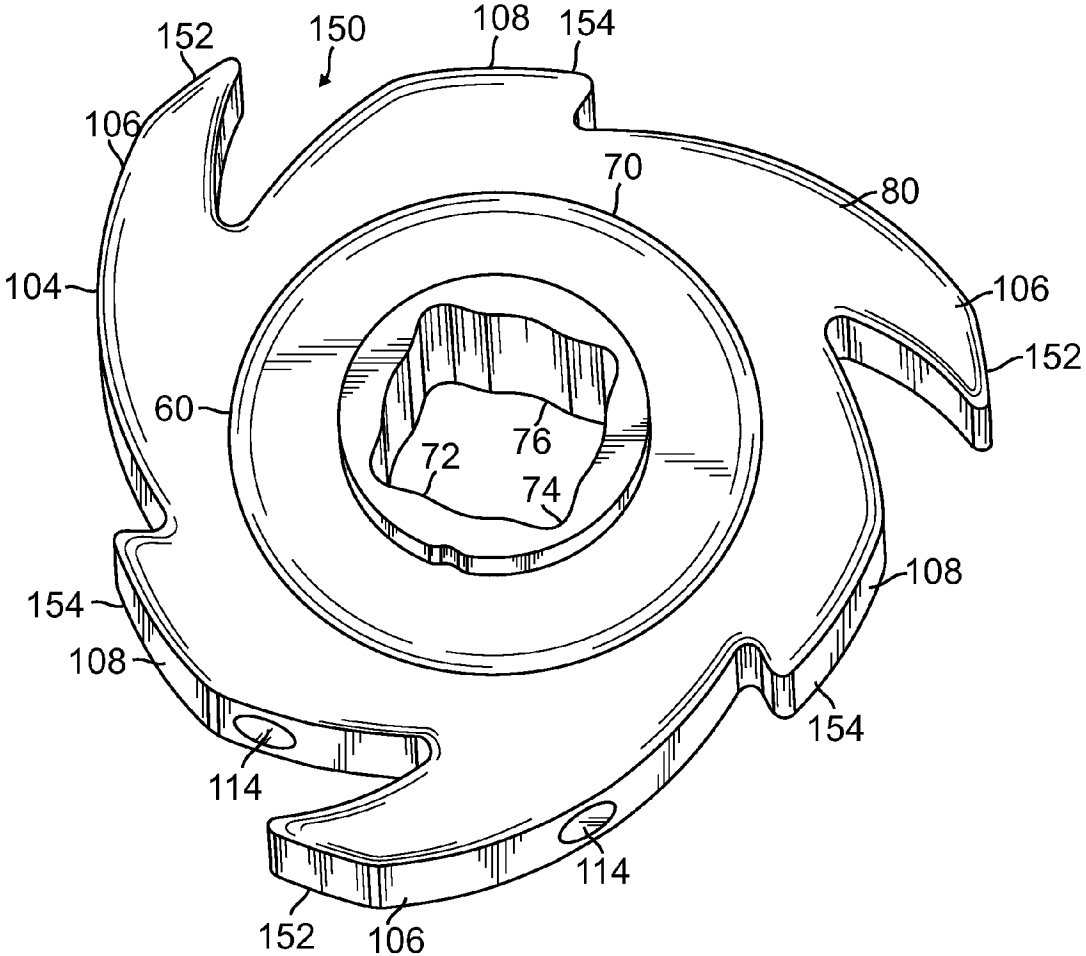
FIG. 8 is a perspective view of an assembled disc, according to a still yet further embodiment of the present invention.

FIG. 8 shows an assembled disc 150, such as a disc assembled from the disc core 60 from FIG. 5 and the outer flexible portion 80 from FIG. 6. The contoured outer surface 104 of the outer flexible material 80 may comprise a series of step regions 154 formed about the periphery thereof. The varied nature of the contoured outer surface 104, such as features long fingers 106, short fingers 108, and step regions 154 support separation of mixed recyclables as each feature acts differently on materials of various sizes, flexibilities, rigidness, and other aspects.

Figure 9:
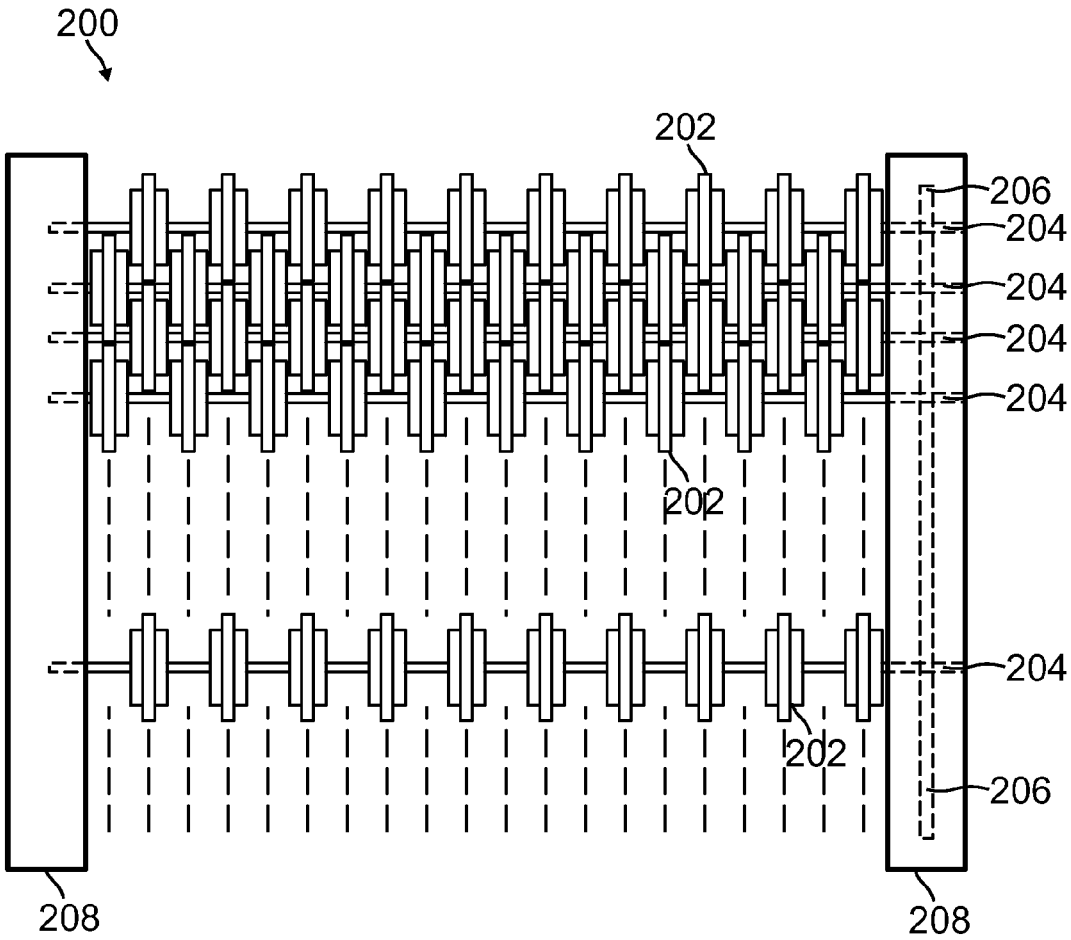
FIG. 9 is a plan view of a disc screen apparatus, according to further embodiment of the present invention.

Referring to FIG. 9, a top view of disc screen section 200 comprises discs 202 mounted on shafts 204. The shafts 204 are mounted between two end portions of the frame 208. A drive mechanism 206 engages with an end of shafts 204 to cause the shafts 204 to rotate about the central axis of the discs 202 in a controlled manner. The disc screen section 200 may be a disc and shaft assembly for a disc screen of a recycling apparatus configured to separate mixed recyclable materials according to size. A shaft 204 may have opposite ends configured to be rotatably supported in a frame 208 of the recycling apparatus. A plurality of discs 202 may be mounted at spaced intervals along the shaft 204 to rotate with the shaft 204 and configured for classifying a stream of mixed recyclable materials. Each disc 202 may comprise an outer flexible portion 80, the outer flexible portion 80 consisting of one piece, without a hinge or interconnecting flap and a disc core 60 connected to the outer flexible portion 80 with a mating connection. The shaft 204 extending transversely through bores 72 within the plurality of discs 202. Each outer flexible portion (material) 80 is shaped for engaging materials to be classified and propelling the materials in a conveying direction when the disc core 80 is rotated.

The foregoing description is of the best currently contemplated modes of carrying out the invention. The description is not to be taken in a limiting sense, but is made merely for the purpose of illustrating the general principles of the invention, since the scope of the invention is best defined by the appended claims.

It should be understood, of course, that the foregoing relates to exemplary embodiments of the invention and that modifications may be made without departing from the spirit and scope of the invention as set forth in the following claims.

Furthermore, a method may be performed in one or more sequences other than the sequence presented expressly herein.

We claim:

1. A disc for attachment to a shaft in a disc screen apparatus, comprising:

an outer flexible material;

the outer flexible material consisting of one piece, without a hinge or interconnecting flap; and a disc core connected to the outer flexible material with a mating connection, wherein the disc core comprises a first lip, a second lip extending radially between the first lip and an outer disc core ridge, extending radially from a center passage, wherein the second lip engages with a portion of the outer flexible material.

2. The disc of claim 1, wherein the disc core is separable into a plurality of portions that can be assembled around a shaft.

3. The disc of claim 1, wherein the outer disc core ridge comprises concave portions and convex portions.

4. The disc of claim 1, wherein the center passage comprises concave portions and convex portions.

5. The disc of claim 1, wherein the outer flexible material comprises convex portions and concave portions situated within the interior of the outer flexible material to engage with an outer perimeter of the disc core.

6. A disc for a recycling apparatus, comprising:

a disc core comprising a first lip and a second lip, extending radially between the first lip and an outer disc core ridge, the outer disc core ridge extending radially from a center passage, the center passage comprising a concave portion and a convex portion; and an outer flexible portion removably mounted to the disc core to project beyond the disc core to contact waste material being processed by a recycling apparatus as the shaft member rotates;

wherein the outer flexible portion comprises ridges that mate with the second lip and the outer disc core ridge fits in between the ridges.

7. The disc of claim 6, wherein the outer flexible portion comprises a contoured outer surface with long fingers, short fingers and step regions between the long fingers and the short fingers.

8. The disc of claim 7, wherein the outer flexible portion comprises convex portions and concave portions situated within the interior of the outer flexible material to engage with an outer perimeter of the disc core.

9. The disc of claim 6, wherein the disc core comprises a pair of portions that can be assembled around a shaft.

10. A disc and shaft assembly for a disc screen of a recycling apparatus configured to separate mixed recyclable materials according to size, comprising:

a shaft having opposite ends configured to be rotatably supported in a frame of a recycling apparatus;

a plurality of discs mounted at spaced intervals along the shaft to rotate with the shaft and configured for classifying a stream of mixed recyclable materials;

each disc comprising an outer flexible portion, comprising convex portions and concave portions situated within the interior of the outer flexible portion;

a disc core connected to the outer flexible portion with a mating connection to convex portions and concave portions situated within the interior of the outer flexible portion;

the shaft extending transversely through bores within the plurality of discs; and each outer flexible portion material is shaped for engaging materials to be classified and propelling the materials in a conveying direction when the disc core is rotated.

11. The disc and shaft assembly for a disc screen of claim 10, wherein the disc core is separable into a plurality of portions that can be assembled around a shaft.

12. The disc and shaft assembly for a disc screen of claim 10, wherein the outer flexible portion comprises of one piece, without a hinge or interconnecting flap.

13. The disc and shaft assembly for a disc screen of claim 10, wherein the disc core comprises an outer disc core ridge;

wherein the outer flexible portion comprises ridges and the outer disc core ridge fits in between the ridges.

14. The disc and shaft assembly for a disc screen of claim 10, wherein the disc core comprises an outer disc core ridge comprising concave portions and convex portions.

15. The disc and shaft assembly for a disc screen of claim 10, wherein the outer flexible portion comprises a contoured outer surface with integral long fingers, integral short fingers, and integral step regions between the integral long fingers and the integral short fingers.

* * * * *